US010870525B1

(12) United States Patent
Wood

(10) Patent No.: US 10,870,525 B1
(45) Date of Patent: Dec. 22, 2020

(54) PROTECTIVE PADDED PANEL

(71) Applicant: Lloyd Wood, St Petersburg, FL (US)

(72) Inventor: Lloyd Wood, St Petersburg, FL (US)

( * ) Notice: Subject to any disclaimer, the term of this patent is extended or adjusted under 35 U.S.C. 154(b) by 0 days.

(21) Appl. No.: 16/502,542

(22) Filed: Jul. 3, 2019

(51) Int. Cl.
*B65D 81/127* (2006.01)

(52) U.S. Cl.
CPC ..... *B65D 81/127* (2013.01)

(58) Field of Classification Search
CPC ..... B65D 81/127; B65D 71/04; B65D 85/30; B65D 81/05; B65D 81/02; B60R 5/00; B61D 45/006; B62D 33/042; B60P 7/15
USPC ..... 206/453, 454, 449, 597, 818, 586; 248/346.4; 410/129, 155, 118, 89, 117, 410/127
See application file for complete search history.

(56) References Cited

U.S. PATENT DOCUMENTS 4,957,400 A 9/1990 Karp
5,269,422 A * 12/1993 Chevrette ..... B65D 5/5042 206/448
5,800,106 A * 9/1998 Miller ..... B60P 7/0807 24/303
9,333,899 B1 * 5/2016 Bullock ..... B61D 45/006
2008/0131226 A1 * 6/2008 Pesson ..... B60P 7/14 410/129
2015/0191968 A1 * 7/2015 Choo-Kang ..... F25D 25/00 160/378

* cited by examiner

*Primary Examiner* — Rafael A Ortiz
(74) *Attorney, Agent, or Firm* — Sanchelima & Associates, P.A.; Christian Sanchelima; Jesus Sanchelima

(57) ABSTRACT

A protective padded panel that comprises a panel member of a predefined shape and magnetic cap members mounted on the corner members of the panel member is disclosed herein. The panel member comprises a covering member comprising a front layer and a back layer made of a first material, and an inner member made of a second material. Dimensions of the front layer, the back layer, and the inner member are the same. The inner member is embedded within the front layer and the back layer and define a first dimension, a second dimension, and a third dimension. The corner members are defined by the embedded inner member. Each magnetic cap member encompasses at least portions of adjacent surfaces along the third dimension of the corresponding corner member and a defined portion along a plane of the first dimension and the second dimension along the back layer.

7 Claims, 1 Drawing Sheet

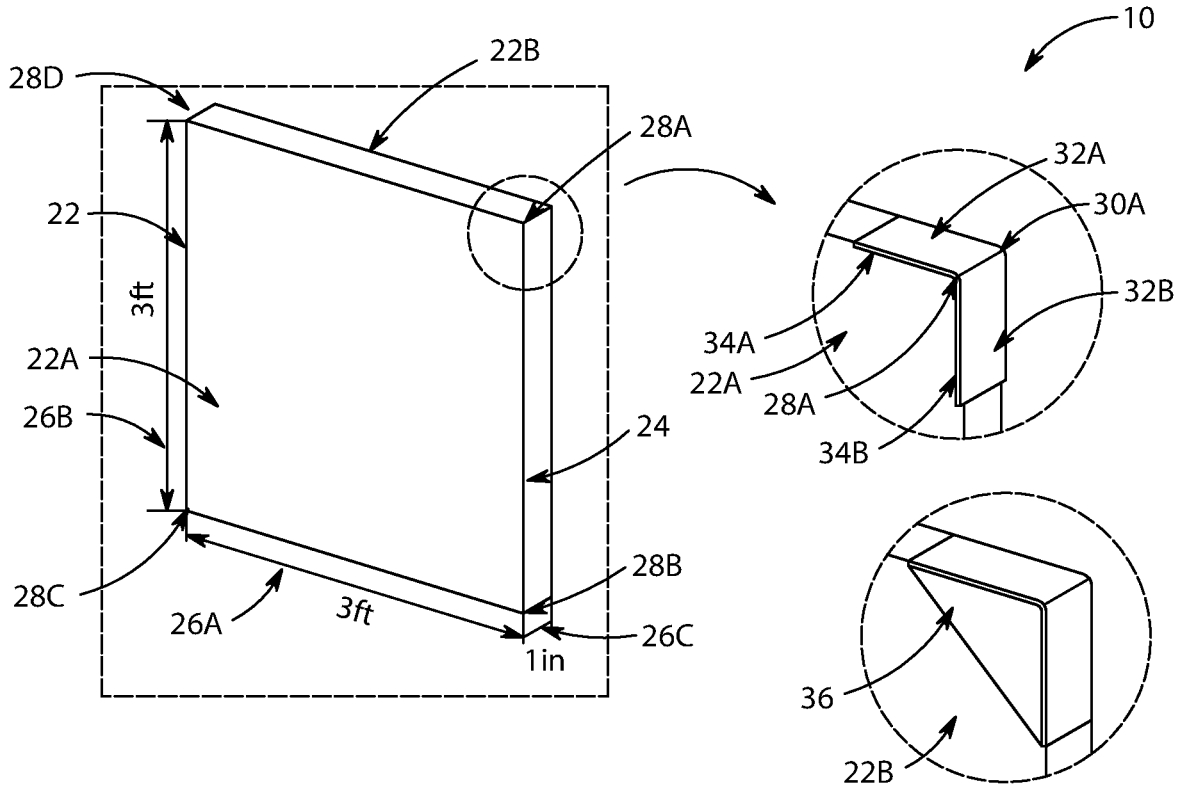
10
22B
28D
28A
22
3ft
22A
26B
24
28C
26A
3ft
28B
26C
1in
32A
30A
32B
34A
22A
28A
34B
36
22B

PROTECTIVE PADDED PANEL

BACKGROUND OF THE INVENTION

1. Field of the Invention

The present disclosure relates to a protective padded panel. More particularly, present disclosure relates to a protective padded panel for protecting objects during transportation.

2. Description of the Related Art

Generally, during transportation of objects from one place to another, such objects may get scratched, scarred, marred or otherwise damaged in one way or another. Thus, padding of such objects may be done by rags, blankets or newspapers to avoid such damage. However, such padding often proves to be unsatisfactory as it tends to slip or fall out of place because of the vibration of moving vehicle during transportation.

Applicant believes that a related reference corresponds to United States Utility Patent U.S. Pat. No. 4,957,400A issued to John D. K Karp discloses a set of pickup truck protective pads for carrying long loads. United States Utility Patent U.S. Pat. No. 8,550,527B1 issued to Joseph T S. Win discloses protective assemblies easily installed on a truck, in association with a truck bed and upright side walls or panels, to protect loads carried by the truck.

However, the above references differ from the present invention because the present invention discloses a protective padded panel for protecting objects during transportation.

Other documents describing the closest subject matter provide for a number of more or less complicated features that fail to solve the problem in an efficient and economical way. None of these patents suggest the novel features of the present invention.

SUMMARY OF THE INVENTION

It is one of the main objects of the present invention to provide a protective padded panel and avoid the drawbacks of the prior art.

It is an object of present invention to provide a protective padded panel that comprises a panel member of a defined shape and magnetic cap members mounted on corner members of inner member of panel member. Panel member comprises a covering member comprising a front layer and a back layer made of a first material, and an inner member made of a second material. Dimensions of front layer, the back layer, and the inner member are the same. The inner member is embedded within said front layer and said back layer and define a first dimension, a second dimension, and a third dimension. Corner members are defined by said covering member and said embedded inner member. Each magnetic cap member encompasses at least portions of adjacent surfaces along said third dimension of corresponding corner member and a defined portion along a plane of said first dimension and said second dimension along said back layer.

Further objects of invention will be brought out in following part of specification, wherein detailed description is for purpose of fully disclosing invention without placing any limitations thereon.

BRIEF DESCRIPTION OF DRAWINGS

With the above and other related objects in view, the invention consists in the details of construction and combination of parts as will be more fully understood from the following description, when read in conjunction with the accompanying drawings in which:

FIG. 1 represents an exemplary protective padded panel 10 of present invention, according to various embodiments described herein.

DETAILED DESCRIPTION OF THE EMBODIMENTS OF THE INVENTION

The following detailed description is intended to provide example implementations to one of ordinary skill in the art, and is not intended to limit the invention to the explicit disclosure, as one or ordinary skill in the art will understand that variations can be substituted that are within the scope of the invention as described.

The present invention discloses a protective padded panel that comprises a panel member of a defined shape and magnetic cap members mounted on corner members of inner member of panel member. Panel member comprises a covering member comprising a front layer and a back layer made of a first material, and an inner member made of a second material. Dimensions of front layer, the back layer, and the inner member are the same. The inner member is embedded within the front layer and the back layer and define a first dimension, a second dimension, and a third dimension. Corner members are defined by the embedded inner member. Each magnetic cap member encompasses at least portions of adjacent surfaces along the third dimension of corresponding corner member and a defined portion along a plane of the first dimension and said second dimension along said back layer.

Various features and embodiments of a protective padded panel are explained in conjunction with the description of FIG. 1.

FIG. 1 represents a protective padded panel 10 of the present invention, according to various embodiments described herein. As illustrated, protective padded panel 10 may comprises a panel member 20 of a predefined shape. The shape may correspond to a square shape, a rectangular shape, or other shape with which protective padded panel 10 may be suitably stacked sideways against one another. For example, other shapes may include at least one straight bottom boundary so that panel member 20 may be easily fixed against a wall of a transportation vehicle, such as a transportation truck.

In an embodiment, panel member 20 may comprise a covering member 22 comprising a front layer 22A and a back layer 22B made of a first material. First material of front layer 22A and back layer 22B may correspond to a durable and scratch-resistant material. Due to such properties of first material, protective padded panel 10 may have a longer life span, thus being cost effective for user.

Panel member 20 may further comprise an inner member 24 made of a second material. Second material of inner member 24 may corresponds to a thick and durable foam material. Due to such properties of second material, protective padded panel 10 may act as a cushion between multiple objects or between an object and a wall of the transportation vehicle, such as a transportation truck. For example, when delicate furniture items are transported from one place to another place, protective padded panel 10 may be placed between two such items, and between an item and wall of transportation vehicle, such as a transportation truck. Protective padded panel 10 may act as a shock absorbent panel and protects such delicate items from any damage during transportation or while loading and unloading of items.

In an embodiment, dimensions of front layer 22A, back layer 22B, and inner member 24 are the same. Said differently, shapes of front layer 22A, back layer 22B, and inner member 24 are the same. Structurally, inner member 24 may be embedded within front layer 22A and back layer 22B of covering member 22 and set by use of an adhesive material, known in the art, so as to protect against any displacement of any layer with respect to each other. Accordingly, such structure may define a first dimension 26A, a second dimension 26B, and a third dimension 26C of panel member 20, as illustrated in FIG. 1. First dimension 26A may be along a length of panel member 20, second dimension 26B may be along a breadth of panel member 20, and third dimension 26C may be along a width of panel member 20. For example, first dimension 26A and second dimension 26B may correspond to two equal sides of panel member 20 having square shape. In an example use case, first dimension 26A and second dimension 26B may measure 3 feet each. Third dimension 26C of panel member 20 may correspond to width of panel member 20. In example use case, third dimension 26C may measure 1 inch.

In an embodiment, as illustrated in FIG. 1, embedded inner member 24 may define corner members 28A to 28D. On such corner members 28A to 28D, magnetic cap members 30A to 30D may be mounted. Each magnetic cap member may encompass at least portions of adjacent surfaces along third dimension 26C of corresponding corner member and a defined portion along a plane of first dimension 26A and second dimension 26B along back layer 22B. In an example embodiment, as illustrated in FIG. 1, a portion 32A along first dimension 26A and another portion 32B along second dimension 26B may be encompassed by magnetic cap member 30A mounted on corner 28A. Further, a defined portion 36 may be encompassed by magnetic cap members 30A along plane of first dimension 26A and second dimension 26B along back layer 22B that may be substantially of a triangular shape.

In an embodiment, each of such magnetic cap members 30A to 30D may include flanges that may be configured to engage each magnetic cap member with corresponding corner. For example, as illustrated in FIG. 1, magnetic cap member 30A may include flanges 34A and 34B that may be configured to engage magnetic cap member 30A with corresponding corner 28A along front layer 22A. In an embodiment, magnetic cap members 30A to 30D mounted on corner members 28A to 28D of panel member 20 may be disposed inside covering member 22.

In an embodiment, magnetic cap members 30A to 30D mounted on corner members 28A to 28D of panel member 20 are configured to magnetically engage with a metallic surface. Metallic surface may correspond to walls of transportation vehicle, such as a transportation truck. Allowing protective padded panel 10 to provide a cushioned interface between such metallic surface and another surface. Another surface may correspond to an object, such as a delicate furniture item being relocated via transportation vehicle, such as transportation truck.

In an embodiment, two instances of such protective padded panel 10 may be configured to magnetically engage sidewise with one another.

Proposed protective padded panel 10 may provide various advantages over conventionally used padding material. Protective padded panel 10 may be easily placed at back of moving van or truck to protect furniture or other objects while moving. Protective padded panel 10 have magnets mounted on each corner and easily stick to inside walls of van or truck. Such magnets may enable two instances of protective padded panel 10 to stick together at sides. This function will not only allow the two instances of protective padded panel 10 to stick to the walls of truck but also to each other. In case such instances of protective padded panel 10 need to be placed between objects being moved, such instances of protective padded panel 10 are able to stick to each other makes them stay in place during transport. As protective padded panel 10 is padded with foam, they protect such objects from all possible damage while transportation, loading, or unloading. Thus, proposed protective padded panel 10 is easy to install, easy to use, durable, easy to store, easy to stack, and does not take much space.

It is to be understood that the above-described arrangements are only illustrative of the application of the principles of the present invention. Numerous modifications and alternative arrangements may be devised by those skilled in the art without departing from the spirit and scope of the present invention and the appended claims are intended to cover such modifications and arrangements. Thus, while the present invention has been shown in the drawings and fully described above with particularity and detail in connection with what is presently deemed to be the most practical and preferred embodiment(s) of the invention, it will be apparent to those of ordinary skill in the art that numerous modifications, including, but not limited to, variations in size, materials, shape, form, function and manner of operation, assembly and use may be made without departing from the principles and concepts set forth herein.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. A protective padded panel, said protective padded panel comprising:

a panel member of a predefined shape, wherein said panel member includes a covering member comprising a front layer and a back layer made of a first material, an inner member made of a second material, wherein dimensions of said front layer, said back layer, and said inner member are the same, wherein said inner member is embedded within said front layer and said back layer and define a first dimension, a second dimension, and a third dimension and corner members defined by said embedded inner member; and magnetic cap members mounted on corresponding of said corner members of inner member of said panel member, wherein each magnetic cap member encompasses at least portions of adjacent surfaces along said third dimension of corresponding one of said corner members and a defined portion along a plane of said first dimension and said second dimension along said back layer, said magnetic cap members mounted on said corner members of inner member are disposed inside said covering member.

2. The protective padded panel of claim 1, wherein said second material of said inner member corresponds to a foam material.

3. The protective padded panel of claim 1, wherein flanges of at least one of magnetic cap members are configured to engage with at least one of said corner members.

4. The protective padded panel of claim 1, wherein said magnetic cap members mounted on said corner members of said inner member magnetically engage with a metallic surface.

5. The protective padded panel of claim 4, wherein said protective padded panel provides a cushioned interface between said metallic surface and another surface.

6. The protective padded panel of claim 1, wherein said first dimension is along a length of said panel member, said second dimension is along a breadth of said panel member, and said third dimension is along a width of said panel member.

7. The protective padded panel of claim 1, wherein said predefined shape corresponds to a square shape or a rectangular shape, wherein said defined portion encompasses by said magnetic cap members along said plane of said first dimension and said second dimension along said back layer is substantially of a triangular shape.

* * * * *